United States Patent [19]

Gramlich

[11] 4,361,988

[45] Dec. 7, 1982

[54] BRAKE DISC GRINDING METHOD AND APPARATUS

[76] Inventor: Hans Gramlich, 4 Melanie Dr., Unit 15, Mississauga, Ontario, Canada, L5S 1H2

[21] Appl. No.: 214,467

[22] Filed: Dec. 8, 1980

Related U.S. Application Data

[63] Continuation-in-part of Ser. No. 163,012, Jun. 25, 1980, abandoned, which is a continuation of Ser. No. 940,975, Sep. 11, 1978, abandoned.

[30] Foreign Application Priority Data

Jun. 29, 1978 [CA] Canada ..... 306470

[51] Int. Cl.[3] ..... B24B 23/02

[52] U.S. Cl. ..... 51/118; 51/132; 51/241 S; 51/281 SF

[58] Field of Search ..... 51/117, 118, 132, 241 R, 51/241 B, 241 S, 258, 251, 259, 281 SF

[56] References Cited

U.S. PATENT DOCUMENTS

| | | | |
|---|---|---|---|
| 3,456,401 | 7/1969 | Kushmuk | 51/259 |
| 3,500,589 | 3/1970 | Ellege | 51/132 |
| 3,521,411 | 7/1970 | Hennig et al. | 51/281 |
| 3,548,549 | 12/1970 | Dunn | 51/118 |
| 3,590,537 | 7/1971 | Hennig | 51/241 S |
| 3,619,952 | 11/1971 | Leming | 51/117 |
| 3,691,878 | 9/1972 | Mitchell | 51/237 R |
| 3,823,627 | 7/1974 | Scharfen | 51/118 |

FOREIGN PATENT DOCUMENTS

| | | |
|---|---|---|
| 815782 | 6/1969 | Canada . |
| 864769 | 3/1971 | Canada . |
| 1905891 | 12/1964 | Fed. Rep. of Germany . |
| 1906407 | 12/1964 | Fed. Rep. of Germany . |
| 2316672 | 3/1974 | Fed. Rep. of Germany . |
| 1352248 | 1/1964 | France . |
| 585756 | 2/1947 | United Kingdom . |

*Primary Examiner*—Harold D. Whitehead
*Attorney, Agent, or Firm*—Charles A. Blank

[57] ABSTRACT

The invention provides a method of apparatus for refinishing a vehicle brake disc. The brake disc is rotated while in place on the vehicle and is brought into contact with one or more abrading discs, which are rotated as well, thereby grinding the brake disc. The abrading discs are maintained in contact with the brake disc by being mounted on a holder which is secured into a portion of the vehicle which is fixed with respect to the brake disc. The preferred arrangement is to attach the holder to the brake caliper mounting associated with the brake disc to be ground. In a preferred embodiment two abrading discs are used, and they can be adjusted to be slightly out of parallel with one another, so as to grind the brake disc with more pressure in a desired region than in another region.

22 Claims, 9 Drawing Figures

BRAKE DISC GRINDING METHOD AND APPARATUS

RELATED APPLICATION DATA

This application is a continuation-in-part of application Ser. No. 163,012, filed June 25, 1980 and now abandoned, which is a continuation of application Ser. No. 940,975 filed Sept. 11, 1978 and now abandoned.

FIELD OF THE INVENTION

This invention relates to a method of grinding brake discs and to a machine for the regrinding of brake discs which form a portion of disc brakes.

DISCUSSION OF THE PRIOR ART

Discs brakes are widely used on motor vehicles, particularly automobiles. Generally such brakes have a disc attached to the vehicle wheel to be braked, and brake shoes which approach the opposite sides of the disc when braking is desired, and engage the disc, whereby to slow the wheel through friction. The brake shoes usually have brake linings of asbestos or other high-friction material, whereas the disc itself is usually a suitable metal, which will dissipate the heat of friction rapidly and which will be sturdy during operation. Often the brake disc is formed of two spaced disc members to engage the brake shoes with a metal web between the disc members to help dissipate the heat of friction.

During the operation of a motor vehicle, brake discs frequently become contaminated by such material as oil and grease, or they may become rusty. Oil and grease reduce the friction between the brake shoes and the brake disc, and may cause the brakes to fail to function when they are needed. Rust, on the other hand, may increase the friction, causing the brake to seize or "grab".

In order to remove rust and contamination, and assure that the disc surface is smooth so as to be suitable for gripping the brake shoes, regrinding of brake discs is often necessary. Thus, a large industry has developed to regrind brake discs.

Generally, the regrinding of brake discs is done in machine tools such as brake lathes, which require the brake discs to be removed from the vehicle for the regrinding process. Some lathes require the further disassembly of the disc from the wheel hub with which it is associated, whereas others, such as, for example, that shown in U.S. Pat. No. 3,456,401 to Kushmuk, permit the disc to be reground while still attached to the wheel hub, after the wheel hub is removed from the vehicle. Some devices, such as that shown in U.S. Pat. No. 3,500,589 of Ellege require a two-stage process, with a first turning step and a second, grinding step. In that patent a free-rotating grinding wheel, mounted on a universal mounting, is used to finish the surface of a disc after grinding. The provision of flexible finishing discs, for finishing after rough facing on a brake lathe, is shown in Leming U.S. Pat. No. 3,619,952. Other designs (only some of which have been disclosed for brake refinishing purposes) use opposed cutting members (as in Scharfen U.S. Pat. No. 3,823,627), or opposed grinders (as in Dunn U.S. Pat. No. 3,548,549, Armstrong British Pat. No. 585,756, and Cipolloni West German Application No. 1,906,407). These prior designs all require large machine tools, in most cases brake lathes. Machine tools and tooling for them are expensive, and require a high capital investment by shops wishing to use them. Additionally, the time taken to disassemble the wheel from the vehicle prior to regrinding leads to delay and high cost for the regrinding operation.

Because of the disadvantages of requiring disassembly of the wheel from the vehicle, several attempts have been made to develop a machine which would regrind the wheel discs while they are still in place on a vehicle. West German published patent application No. 2,316,672 of the present inventor shows one such proposal. Another generally similar proposal is shown in U.S. Pat. Nos. 3,521,411, and 3,590,537 to Hennig and Kammermayer.

Experience with devices such as those shown in the German published application and U.S. Patents discussed above has shown that these devices are not fully satisfactory for the regrinding of brake discs. In particular, discs reground with such devices frequently exhibit scoring of the disc surface, which may at times be so severe as to render the disc useless. Even when extensive scoring is not present, the discs do not exhibit the same smoothness and uniformity of finish as is available from factory-finishing or refinishing.

It has also been proposed to grind brake discs in place with machines mounted on the ground below the vehicle. Examples of such machines are shown in French Pat. No. 1,352,248 of Brunella and German application No. 1,905,891 of Wampouille. To function, such machines must be positioned so that their grinding faces are exactly parallel to the faces to be ground of the brake disc, and must have the vehicle wheel off the ground, so that the brake disc associated with it can rotate for grinding. This would result in a situation where the vehicle wheel would sag in its suspension, and bounce or exert sideways thrust on the grinder. Such devices would therefore necessarily grind unevenly, if indeed they could operate at all.

OBJECTS OF THE INVENTION

Accordingly, it is an object of the present invention to provide a device and method for grinding a brake disc when the brake disc is mounted in situ on a vehicle wheel.

It is a further object to provide a device and method for grinding brake discs on a vehicle whereby a smooth, nondirectional finish can be obtained.

BRIEF DESCRIPTION OF THE INVENTION

The invention provides a method of regrinding disc brakes while in position of a motor vehicle, such as for example, an automobile, and apparatus for carrying out that method.

The apparatus of the invention includes a base member, and a means for attaching that base member firmly to a portion of the vehicle which is fixed relative to the axis of rotation of the brake disc to be ground. The base member carries at least one disc support member. On the disc support member is mounted a journal means with a stub axle journalled in it. The stub axle carries an abrading disc fixedly mounted for rotation on the axle.

In another embodiment, the apparatus of the invention includes two rotatable abrading discs each of which has an abrading face and an axle fixedly mounted at right angles to that face. The abrading discs are provided with means for mounting them from a portion of the vehicle which is fixed relative to the axis of rotation of the brake disc, so that the abrading faces can be positioned on each side of a brake disc mounted on the vehicle, and in face-to-face frictional contact with the brake disc. A modification preferred when the brake disc to be ground is warped or has an irregularly worn face, provides grinding discs which are angularly adjustable with respect to one another, so that selective grinding pressure can be put on the brake disc either near its periphery or nears its center, as needed.

In the preferred embodiments of the device, the portion of the vehicle on which the device is designed to be mounted is the brake caliper mounting. The caliper mounting is generally robust and is firmly fixed. However, in some vehicles, there are also portions of the vehicle suspension which are fixed relative to the axis of rotation of the brake disc, and to which the device can be mounted as by clamping. For example, in vehicles which have McPherson strut suspensions, the outer tube of the McPherson strut is usually rigidly fixed with respect to the axis of rotation of the brake disc. If such outer tube is sufficiently sturdy so that it will not collapse when the device of the invention is clamped to it, then the device can be clamped to the outer tube of the McPherson strut. Other suitable portions of the vehicle will vary from vehicle to vehicle, but will be readily apparent to skilled persons, in the light of the teaching herein.

The apparatus according to the invention can be used in conjunction with a means for powering the vehicle wheel on which the disc brake is mounted. Suitably, the powering device can be an electric motor, which is attached to a mounting device boltable to a vehicle wheel such that the motor drives the wheel. However, in cases where the wheel on which the disc brake is located is itself a powered wheel, as for example a wheel driven by the vehicle engine, then it is within the scope of the invention to use the vehicle engine to power that wheel. Preferably, the abrading disc is not powered, but is merely caused to rotate by the rotation of the vehicle wheel and its associated brake disc in contact with the abrading disc during operation. However, it is within the scope of the invention (although not preferred) to power the abrading disc as well.

The invention will now be disclosed further by the description of particular embodiments and illustrated by drawings.

Figure 5:
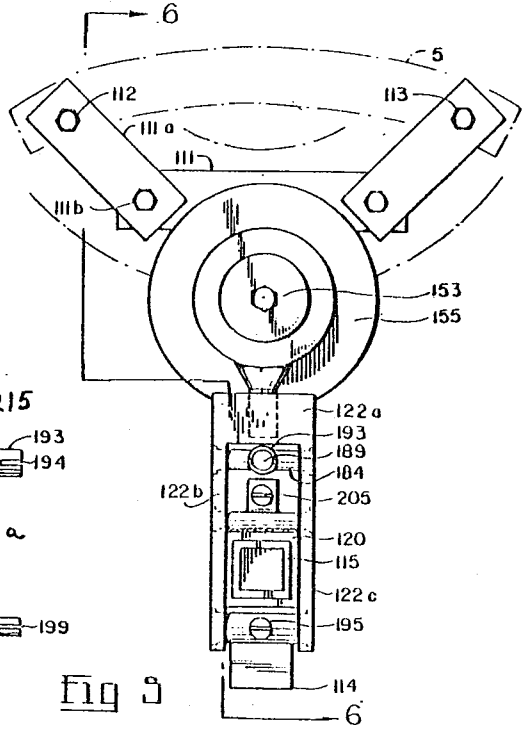
FIG. 5 is a view of an alternate embodiment of the invention, seen from the same position as FIG. 2.
Figure 6:
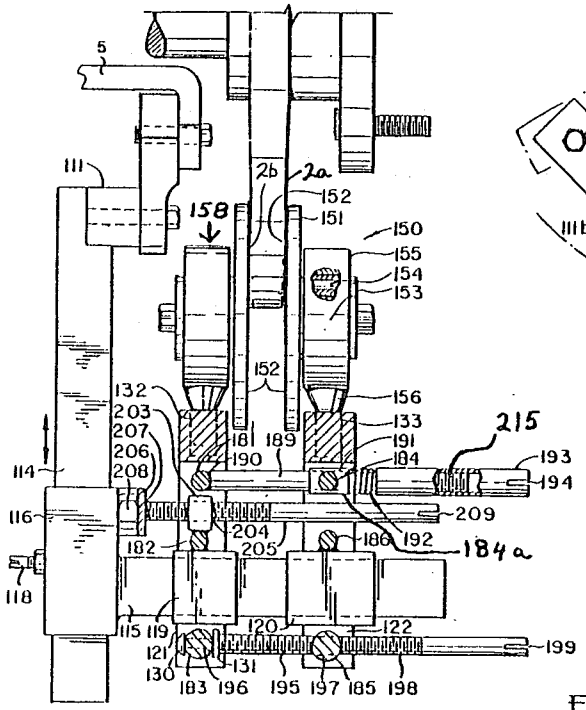
FIG. 6 is shown partially cutaway of the embodiment of FIG. 5, viewed from underneath an automobile. The view is cutaway along the lines 6—6 of FIG. 5.

FIGS. *7a* and *7b* show schematically the use of the embodiment of FIGS. 5 and 6.

Figure 8:
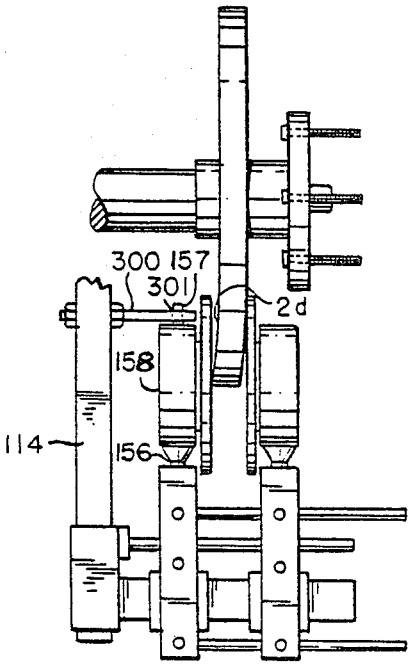

FIG. 8 is a schematic view, seen looking upwardly from under an automobile, of a modification of the embodiment of FIGS. 5 and 6.

DETAILED DESCRIPTION OF THE INVENTION

The embodiments illustrated in FIGS. 1 and 2 will now be described.

Figure 1:
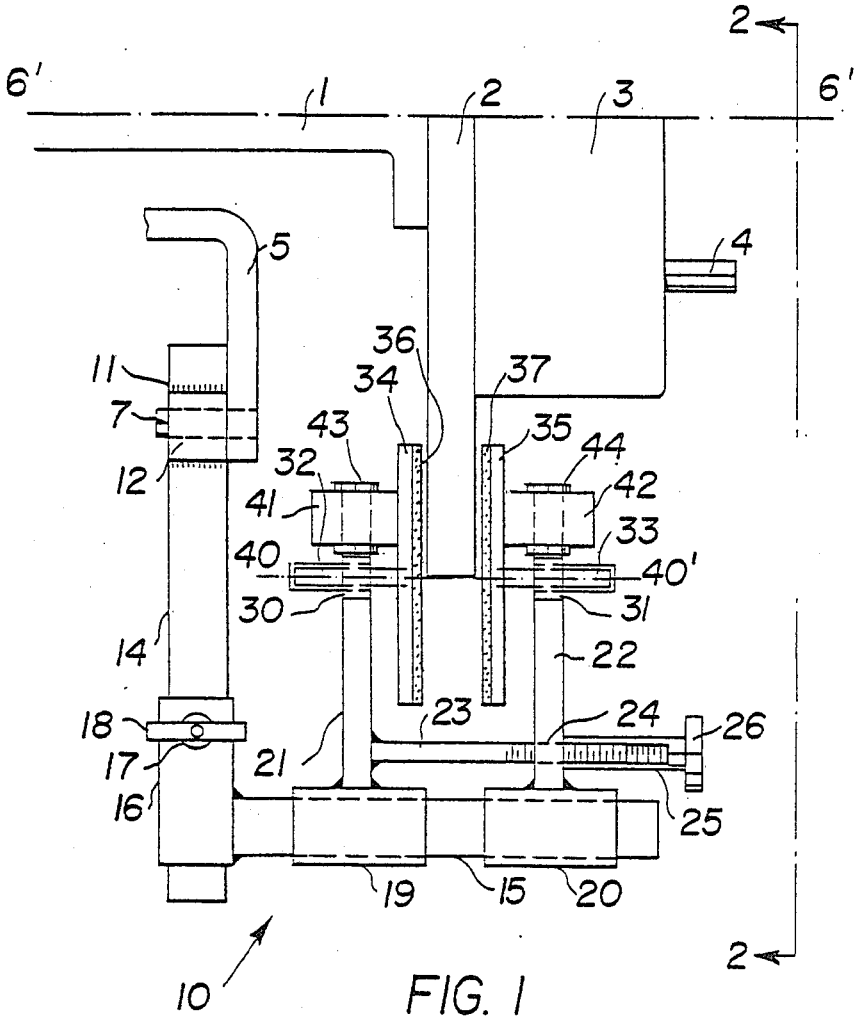
FIG. 1 shows a view, as seen looking upwardly from below an automobile, showing a vehicle wheel and brake disc, with a device according to the present invention mounted thereon for grinding the disc.

In FIG. 1, the vehicle axle is generally shown at 1. The axle has attached to the end of it, as by bolts in conventional fashion, a brake disc 2 and a wheel hub 3. The wheel hub has extending from it a plurality of wheel studs 4. A bracket 5, secured to the frame of the automobile, is provided for the mounting of brake calipers (which are not shown).

In FIG. 1, the axis of rotation of axle 1, disc 2 and wheel 3, all of which rotate as a unit, is shown at 6–6'.

The inventive device is shown generally at 10. As shown, it has an attachment member 11, which is provided with two holes 12 and 13. These holes fit over the caliper-mounting studs 7 and 8, which extend outward from the caliper-mounting bracket 5.

Extending at right angles from attachment member 11 is a connecting member 14, which is rigidly secured, as by welding, to the attachment member 11. Near the end of member 14 remote from member 11, is attached a base member 15. In the figures, member 15 is shown as being slidably mounted on member 14, by means of a sleeve 16 which is rigidly connected to member 15 and which slides on member 14. A set screw 17, having a handle, as shown at 18, attached to it is provided to lock sleeve 16 into position at a desired position on vertical member 14. The member 15 has two sleeves 19 and 20 slidable independently on it. Each of these sleeves bears a grinder supporting member, the two members being respectively designated as 21 and 22. A threaded rod 23 is permanently secured, as by welding or by bolting, to member 21, and passes through member 22 by a suitable hole 24.

An internally-threaded sleeve 25 (shown partially cutaway) having a mating thread to rod 23, is screwed over rod 23. Suitably, the internally-threaded sleeve has a handle 26 attached to one end for adjustment purposes.

In each of the supporting members 21 and 22 is located a hole containing a low friction bushing or ball bearing assembly. These bushings or bearing assemblies are shown as 30 and 31 in the drawings. In each of the bushing or bearing assemblies is journalled a stub axle (shown respectively as 32 and 33). Each stub axle has mounted on it a metal disc (respectively shown as 34 and 35) which is fixed to the axle for rotation therewith. The discs are coated with abrasive as indicated at 36 and 37. Although 36 and 37 are shown as abrasive coatings fixed permanently to the discs 34 and 35, it is of course possible to have the abrasives mounted on removable pads, which can be replaced when the abrasive becomes worn.

In the drawings, the two axles 32 and 33 are shown as having the same axis which is shown by number 40–40'. It will be noted that this axis lies outside the periphery of the brake disc 2. It is not necessary that the two axles have the same axis. Usually they will be parallel to each other, and parallel, when the apparatus is in operating position, to the axis 6–6' of the vehicle wheel and axle. In another embodiment, to be described later, the axles are deliberately adjustable to be non-parallel, so as to provide increased grinding pressure in selected regions of the brake disc.

In order to ensure that the grinding will be even when the device is operating, the axes of both the axles 32 and 33 should lie outside the periphery of the brake disc 2, if discs 34 and 35 are not powered, as will be discussed.

To support the discs 34 and 35, and their associated abrasive pads, and to prevent wobble of such discs, bearings 41 and 42 are provided on the upper ends of upstanding members 21 and 22. Suitable, these bearings are rotatable wheels, of any suitable material, which bear on the back of discs 34 and 35 respectively, to prevent each disc from bending backwards towards its associated supporting member 21 or 22. The bearings 41 and 42 are journalled on the top of members 21 and 22 by a low-friction mounting, such as, for example, a ball bearing assembly shown generally at 43 and 44.

In many present day automobiles, the caliper-mounting bracket is a vertically-oriented crescent shaped piece of metal positioned just to the rear of the axle support the wheel with which it is associated, having its mid-point approximately at the level of the axle. The caliper-mounting bracket 5 illustrated in the drawings is of this type. With such an arrangement the member 11 is oriented approximately vertically, with the member 14 being oriented horizontally and extending rearwardly from the mounting bracket. However, it will be appreciated that the invention can be used with any shape of mounting bracket, merely by modifying member 11 to attach to that bracket. In some cases it may be convenient to hang the apparatus from the mounting bracket so that member 14 depends vertically downward, and member 15 extends horizontally under the brake disc. The precise orientation and form of these members is not important to the invention, provided that the discs 34 and 35 can be positioned as described with respect to the brake disc 2.

It is also within the scope of the invention to mount the apparatus from a portion of the vehicle other than the caliper mounting bracket, provided that the portion of the vehicle on which the apparatus is mounted remains fixed with respect to the axis of rotation 6—6 of the brake disc. If this is done, the attachment member 11 can be provided with a clamp which will clamp tightly to the chosen portion of the vehicle, instead of with holes 12 and 13.

Figures 3, 4:
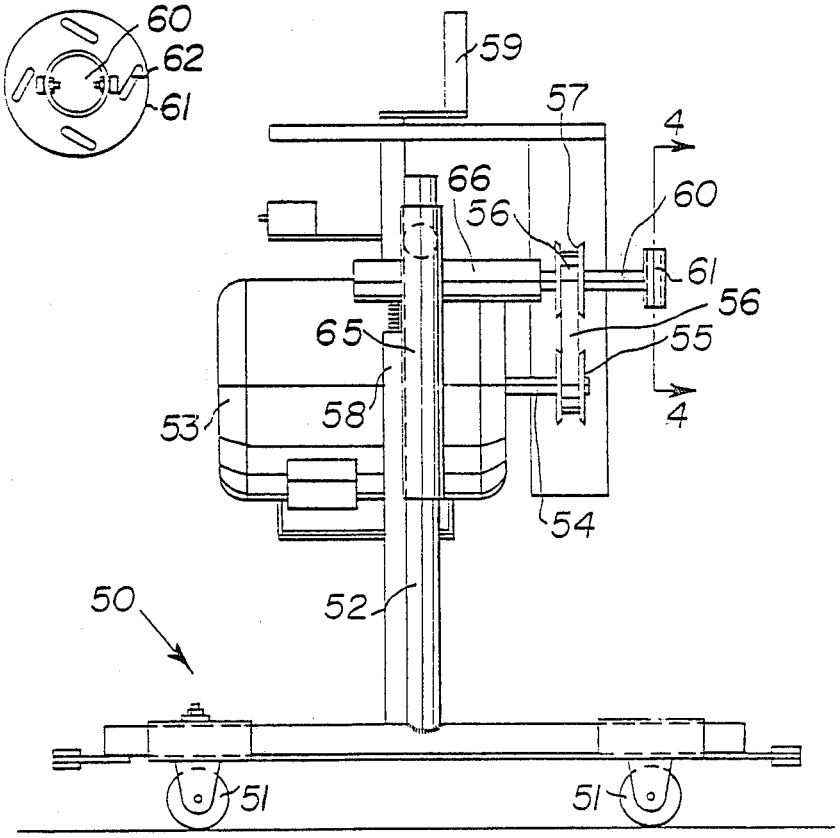
FIG. 3 shows a suitable apparatus for powering a vehicle wheel in order to cause it to rotate while the grinding operation is taking place.
FIG. 4 shows a detail of FIG. 3 in cross-section, as indicated by the lines 4—4 on FIG. 3, with the detail being shown in greatly enlarged scale.

In FIGS. 3 and 4, an apparatus to rotate the brake disc being ground is shown. The rotating apparatus is mounted on a wheeled dolley 50, with wheels 51.

Dolley 50 supports a suitable frame 52, which supports a motor (as for example an electric motor) 53. The motor power take-off 54 is connected to a pulley 55, which is connected through a belt 56 to a second pulley 57 mounted on rotatable member 60, journalled for rotation in a member 66. The entire motor, belt and pulleys are joined together by a rigid frame 65, which slides on frame 52 and is adjustable in its height by handle 59, which is attached to a threaded mating portion of an upstanding member 58 which permits the member to be lengthened. This permits the level of the motor, the two pulleys and the belt above the ground to be varied.

On member 60 is a second power take-off 61. This is preferably a universal take-off. It is provided, as is shown in FIG. 4, with a flange having a plurality of holes 62.

These holes are designed to engage wheel studs, and may be slotted, as shown in FIG. 4, so that they can accommodate the wheel studs of several different types of vehicles and so that they also have, to some extent, a self-centering feature.

Figure 2:
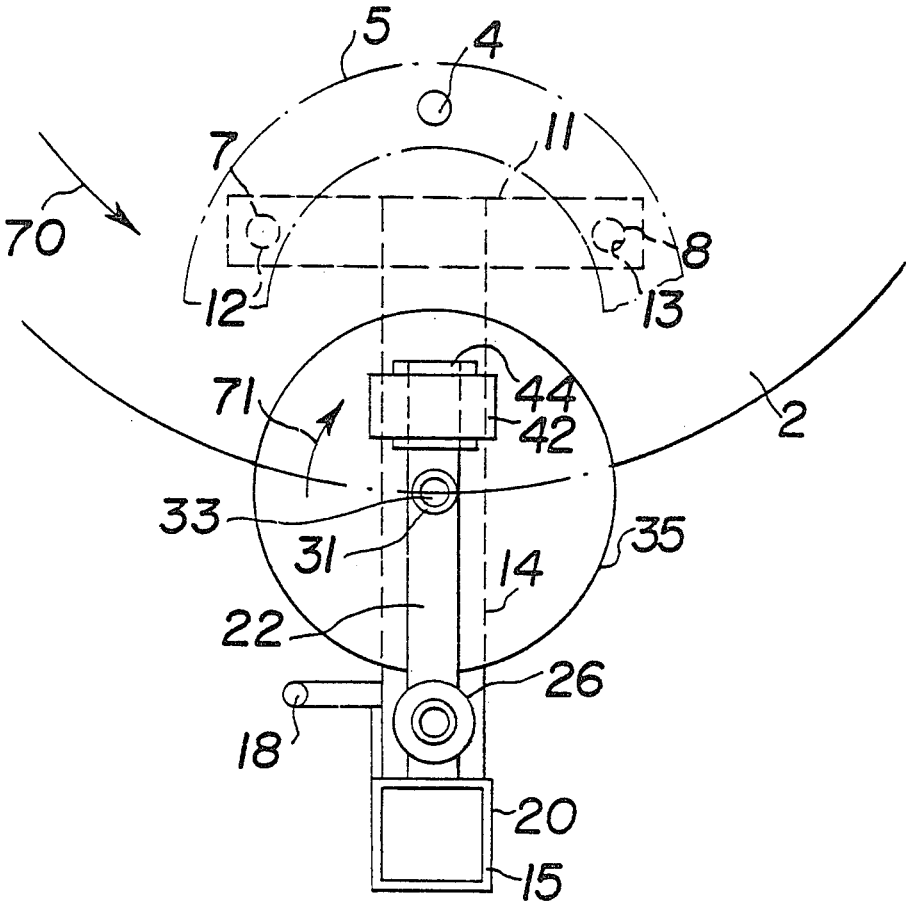
FIG. 2 is a view along the line 2—2 of FIG. 1.

The operation of the apparatus as shown in FIGS. 1 and 2 will now be described. When it is desired to regrind brake discs, the vehicle is placed on a jack or other supporting means and the tire associated with the wheel on which the brake disc is to be reground is preferably removed to provide convenient access and working room. The calipers holding the brake shoes are removed from their association with the disc to be reground.

The apparatus 10 is then attached to the caliper-mounting bracket 5, as by fitting holes 12 and 13 over the caliper-mounting studs. If desired, the member 11 can be bolted to the studs, but this is usually not necessary and it is more convenient, having regard to the difficulty of working under a vehicle, merely to hang the member 11 from the studs. Then, the set screw 18 and the handle 26 are operated so that the two abrasive discs are positioned on opposite sides of the disc to be ground, with the abrasive faces 36 and 37 facing the disc. The axis 40 is positioned to be outside the periphery of the disc. In FIG. 1, this axis is shown as beside the disc, but it is evident that it could be slightly outside the periphery but below or above the disc 2, rather than beside it, if there is sufficient space to mount the apparatus in the orientation. The distance from the axis to the periphery of the disc depends on how much overlap is desired between the abrasive pads 36 and 37 and the disc, which in turn governs how much of the disc will be reground.

The handle 26 is then operated so that the two members 21 and 22 are moved toward each other. This is continued until the two faces 36 and 37 are in tight frictional engagement with the disc 2 to be reground.

Once the apparatus is set up in this way, the wheel 3 and the associated disc 2 are rotated. In some cases, where the vehicle wheel is powered by the vehicle engine, this may be done by actuating the vehicle engine. However, in the majority of cases this will not be feasible. In such cases, it is preferred to rotate the vehicle wheel by applying power to the wheel by external means. One suitable arrangement is that shown in FIG. 3 where motor 53 drives power take-off 61. The handle 59 is adjusted until take-off 60 is at the height of the axle 6 and facing the outside of wheel 3. The slots 62 are fitted over wheel studs 4, and bolts are attached to ensure that the wheel studs remain in position. Then, motor 53 is actuated, causing wheel 3 and disc 2 to rotate.

When wheel 3 and disc 2 rotate, they cause discs 34 and 35, which are in tight frictional contact with disc 2, to rotate also. The directions of rotation are shown by arrows 70 and 71 in FIG. 2. Because of the tight frictional contact between disc 2 and the abrasive surface of 36 and 37, there will of course be considerable bending torques on the metal discs 34 and 35. However, this bending torque is transmitted to the members 21 and 22, which are much more sturdy and better able to resist it, by means of the bearings 41 42. Obviously, the axis of rotation of discs 34 and 35 must be outside the periphery of disc 2, to cause discs 34 and 35 to rotate, if the discs 34 and 35 are unpowered. If the discs were powered independently of the vehicle wheel it would be possible to place the axis of the rotation within the periphery of the brake disc 2. However, this is not preferred, as there is some possibility of scoring the brake disc with this arrangement.

As the discs 34 and 35, with their abrasive coatings 36 and 37 rotate, the abrasive surfaces abrade the opposed faces of wheel disc 2. The effect of the rotary motion of the abrasive discs and of the wheel disc 2 provides a smooth uniform grinding of the disc surfaces.

When the disc surfaces have been ground sufficiently, motor 53 is switched off, and the abrasive pads 36 and 37 are moved out of contact with the disc, completing the grinding process. Optionally, an initial grinding can be done with discs 34 and 35 having abrasive coatings 36 and 37 which have a coarse abrasive, followed by a second grinding operation, replacing those discs with discs having finer abrasive coating.

As mentioned above, the axes of the two axes 32 and 33 need not be the same. It may occur, for example, that it is desired to regrind a larger area on one side of a wheel disc than on the other side. In such a case, a larger disc 34 (for example) than disc 35 would be provided. While it is possible to have the two discs having the same axis 40–40′, it may be convenient to have the larger disc have a different axis of rotation than the smaller disc. This is still within the scope of the invention.

As noted above, it is possible to have only a single disc present, when it is desired to abrade only one side of a brake disc. If this arrangement is used, it will then of course not be possible to have a threaded rod 23 running between the two members 21 and 22, as only one such member would be used. In such a case, member 21 and its associated disc would be removed, and threaded rod 23 would be welded to member 14, instead of member 21. It is not preferred to abrade a single side of the brake disc in this way, as the considerable pressure of the abrading disc 35 and its abrasive coating 37 against the brake disc 2 might cause the brake disc 2 to wobble on its axis. However, in cases where the brake disc 2 is firmly seated on its axis, and only one side of the disc needs to be reground, this arrangement can be used. It would of course also be possible to omit the member 22, rod 23 and handle 25 and instead to leave member 21 in position, with a suitable arrangement to force member 21 toward disc 2, so that abrading disc 34 and its associated abrasive coating 36 are in tight frictional contact with disc 2.

Although the abrading discs 34 and 35 have been shown in the drawings as unpowered, and caused to rotate through their frictional contact with disc 2, it is within the scope of the invention to power such abrading discs. Powering such discs may be advisable where a very polished finish is desired to the disc 2, as the abrading discs can then be caused to rotate at a higher speed than the disc 2, and, when used with very fine abrasive, this will result in a highly polished finish.

The embodiment of FIGS. 5, 6 and 7 will now be described.

It is found that, in many circumstances, brake discs which are to be resurfaced have become worn unevenly. In some cases, the brake disc is thinner by reason of wear, closer to the center than it is at the periphery. In other instances, the brake disc is thinner at the periphery than it is at the center.

It is therefore useful to provide a brake disc grinder which can grind both sides of a brake disc, as disclosed in the previous embodiments, but with adjustable grinding members with which the operator can choose to grind more heavily at either the periphery or the center of the brake disc as he may decide, thereby compensating for uneven wear by changing the angle between the grinding members. This is accomplished in the present embodiment by providing a grinding apparatus in which the operator can set the grinding faces of two grinding discs, which engage opposite faces of the brake disc to be ground, so that the grinding faces are at a desired angle to one another.

Figure 7A:
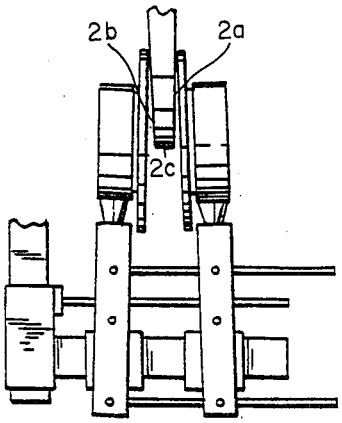
Figure 7B:
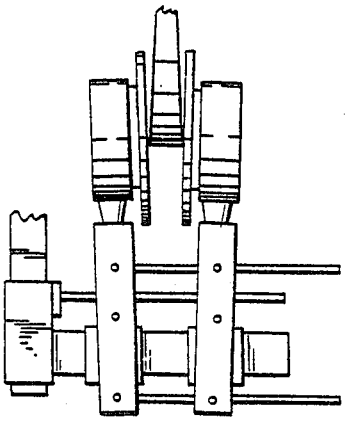

The grinding apparatus of FIGS. 5, 6 and 7 is suitable for use when it is desired to grind the disc in such a way to take more from the periphery than from the inner portion, or more from the inner portion than from the periphery.

The present apparatus also permits use of grinding discs which are mounted on conventional thrust bearings. Such bearings are not preferred with the embodiment shown in FIGS. 1 and 2, as such bearings tend to have a slight amount of play and tend to permit an abrading disc to move slightly from its intended position when under severe thrust. This could conceivably cause a brake disc to be ground unevenly. However, the embodiment shown in FIGS. 5 and 6 compensates for such unevenness, permitting thrust bearings to be used without the likelihood of unevenness.

The embodiment of FIGS. 5 and 6 is used by attaching it to the caliper mounting of an automobile disc brake of the vehicle or to a portion which is fixed relative to the axis of rotation of the brake disc, in the same way as the embodiment of FIGS. 1 and 2 is attached. The attachment members described with respect to the previous embodiment can be used. However, it is preferred to use an attachment member 111 which adjusts to fit the caliper mountings of different types of cars. Member 111 has its holes 112 and 113 positioned in extension pieces 111*a* which can be adjusted with respect to one another, and then locked into the adjusted portions as by bolts 111*b*. In this way, the spacing of holes 112 and 113 can be varied to adapt to the caliper mountings of different automobiles.

FIG. 6 shows a connecting member 114 which corresponds to member 14 of FIG. 1 and is welded to member 111. A sleeve 116 is mounted slideably on member 114. The sleeve can be locked in position on member 114 by a set screw 118.

A base member 115 is welded to member 116, and has two sleeves 119 and 120 positioned to slide loosely on it. Rods 182 and 186 are welded to sleeves 119 and 120 respectively. Grinder supporting members 121 and 122 are respectively mounted on rods 182 and 186.

Members 121 and 122 are both of the same shape. As best shown in FIG. 5, these members are of elongated inverted u-shape. Thus member 122 has an upper transverse portion 122*a* and two legs 122*b* and 122*c*.

The two legs of grinder supporting member 121 are joined by three rods 181, 182 and 183, which are pivotally mounted at their ends in the legs of member 121. The two legs of grinder supporting member 122 are joined by three rods 184, 185 and 186. The two ends of each of these rods are pivotally mounted in legs 122*b* and 122*c* respectively. The only connection of member 121 to sleeve 119 is through rod 182, which is welded to sleeve 119 but which is pivotally connected to member 121. Thus member 121 may move with respect to sleeve 119, by pivoting about rod 182. Similarly, member 112 is connected to sleeve 120 only through rod 186, and can move with respect to sleeve 120 by pivoting about rod 186.

A rod 189 is welded to rod 181, at 190. Rod 189 passes freely through a hole 191 bored in a thickened central portion 184*a* of rod 184. Rod 189 is externally threaded at 215. An internally threaded cap 193 fits over threaded portion 215, and can bear tightly against thickened portion 184*a* of rod 184. Cap 193 is formed with a slotted portion 194 that it can be screwed along portion 215 by inserting a screwdriver head in portion 194. Suitably a helical compression spring 192 fits over portion 215 and bears against cap 193 and thickened portion 184*a* to bias rod 184 in the direction away from member 114.

A rod 195 passes through hole 196 in member 183. Rod 195 can rotate freely in hole 196, but is prevented from lateral movement with respect to rod 183 by nuts 130 and 131. Rod 195 is threaded through rod 185 at 197. Rod 195 is externally threaded as at 198, to mate with the internally threaded hole 197. A slotted end 199 is provided to rod 195, so that it can be turned with a screwdriver.

An upstanding piece 203 extends upwardly from rod 182, and is rigidly attached to rod 182, as by welding. Piece 203 has an internally threaded hole 204 in it. A threaded rod 205 with mating threads extends through hole 204. One end of rod 205 is retained against, but is free to rotate with respect to, sleeve 116. Suitably this is accomplished by providing a retaining member 206 welded to member 116. Retaining member 206 has a hole 207 through which rod 205 passes freely. A nut 208, larger than hole 207, retains the end of rod 205 in the retaining member. A slot 209 is provided at the opposite end of rod 205, so that a screwdriver can be inserted to turn rod 205 and thereby move member 203 along it.

The grinding supporting member 121 has a hole 132 in the base of the inverted u-shape. Similarly, grinder supporting member 122 has a hole 133 in the base of its inverted u-shape. Grinder 158 is mounted in hole 132 and grinder 150 is mounted in hole 133.

Grinder 150 will now be described. Grinder 150 has a rigid disc 151, with an abrasive face 152. Suitably, this abrasive face can be formed by abrasive paper, glued or otherwise suitably secured to the face of the rigid disc. The disc is provided with an axle 153 at right angles to the disc 151. The axle turns in a thrust bearing shown schematically at 154 which permits the axle to rotate in an outer shell 155. The outer shell 155 is provided with a shaft 156, which fits into holes 132 or 133. Grinder 158 is identical with grinder 150, and the same reference numerals are used to describe its parts.

The embodiments of FIGS. 5 and 6 is used to grind normal brake discs in the same manner as the embodiment of FIGS. 1 and 2, but can also be used to correct unevenness in a brake disc. In FIG. *7a*, a disc 2 is shown having two non-parallel sides 2*a* and 2*b*. As shown, face 2*a* is approximately prependicular to the axle (not shown), but face 2*b*, through some damage which it has suffered, is tapered so that the brake disc is considerably thinner at its periphery 2*c* than it is near the axle 1. In FIG. *7b*, a brake disc which has an opposite taper, so that the disc is thicker in its periphery than near its center, is shown. Generally, it would not be expected to find a taper of more than a few thousandths of an inch, but the taper has been accentuated for the purpose of illustration in FIGS. *7a* and *7b*. It is of course desirable to grind these brake discs so that the two faces are parallel.

Grinding with the embodiment of FIGS. 5 and 6 is accomplished as follows:

Cap 193 and rods 205 and 195 are turned by means of a screwdriver in their slotted ends, so that the two grinders 150 and 158 are separated from each other by a distance greater than the maximum thickness of the brake disc 2. Then rod 205 is manipulated by a screwdriver inserted in slot 209, to move grinder 158 against the face 2*b* of the brake disc. Cap 193 and rod 195 may also be turned by a screwdriver at this time, so that member 121 pivots about pivot 182, until the abrading face of the grinder 158 mounted on member 121 makes desired contact with face 2*b*.

Cap 193 and rod 195 are then turned by inserting a screwdriver into slots 194 and 199 respectively. This brings the grinder 150 into contact with the face 2*a* of the brake disc. Cap 193 and rod 195 are then adjusted to pivot the members 121 and 122 about rods 182 and 186 respectively until the abrading faces are at a desired angle to the brake disc to be ground and in frictional contact with the brake disc to be ground. For the initial grinding step, in the case of a brake disc which has worn unevenly, it may be desired to grind off more material from the thick portions of the brake disc than from the thin portions. Thus, in FIG. *7a*, the grinding discs are adjusted to incline slightly towards one another where they overlap the brake disc to be ground. In FIG. *7b*, they are adjusted to incline slightly away from one another. Generally, the inclination is not great, not exceeding an angle of about 5° from the parallel. The inclined angle, however, ensures that the region where the abrading discs approach each other most closely is subjected to more pressure during grinding than the region where they are farther apart, so that more abrasion and material removal occurs where the discs are closest.

Where the brake disc is not very uneven, or after the unevenness has been ground off, the grinding discs are adjusted to be approximately parallel. It is preferred however, even when grinding parallel faces, to have the grinding discs adjusted to incline slightly towards one another as shown in FIG. *7a*, but to a lesser extent. Suitably, the distance between the grinding discs should be from 0.001 to 0.002 inch less where they bear against the portion of the brake disc closest to the axle than where they bear against the circumference of the brake disc. The purpose of a slight "toe-in" such as this is to make the pressure greater on the portion of the brake disc closer to the axle, as this portion is exposed during grinding to less contact with the grinding surface of the grinding discs. An additional purpose of the "toe-in" is to put a slight lateral pressure on the bearings in grinding assemblies 150 and 158 which prevents the axles 153 on which the grinding discs are mounted from wobbling in the bearings. This permits the use of ordinary thrust bearings in assemblies 150 and 158 without having inaccurate grinding occur because of wobble of the grinding heads.

After the grinding assemblies are in position, the vehicle wheel and associated brake disc is rotated, as for about 30 seconds, after which the degree of polish of the brake disc surface and its parallelism are checked. If necessary, a screwdriver is turned in slots 194 and 199 to tighten the grinding discs against the brake disc, and grinding is repeated for a few more seconds. It is found that very precise grinding can be done, and that conditions where the brake disc has worn unevenly can usually be easily corrected.

FIG. 8 shows the further embodiment, which is useful in the grinding of brake discs which have been badly scored, warped, or deformed. Brake discs are frequently warped, a condition which is known in the trade as "run out." The embodiment is the same as that discussed with respect to FIGS. 5, 6 and 7, except that it provides an added bracing member 300. This bracing member has a hole 301 near one end. This hole 301 fits over a rod 157, which is mounted in the top of a grinder member 158, coaxial with hole 132. The other reference numbers are the same as in FIGS. 5 and 6. The bracing member is attached to member 114 by a suitable clamp, as shown in FIG. 8, for rigidity.

In FIG. 8, a brake disc having a warped portion **2*d* (drawn greatly exaggerated) is shown. The grinding device is adjusted so that the two grinding surfaces 152 are approximately parallel to one another (with a very slight "toe-in" if desired, to prevent movement of axles 153 in the bearings). Grinder 158 is mounted parallel to member 114, with bracing member 300 mounted on member 114, and rod 157 passing through hole 301 in a tight fit which however permits pivoting of the grinder on the axis of rods 156 and 157. Bracing member 300 provides extra rigidity to grind down the warped portion 2*d* while the grinding process proceeds. The warped portion tends to force the grinding wheels apart when it passes between them, but the bracing member imparts extra rigidity because it and rod 157 prevent the grinder 158 from deflecting either closer to or farther from member 114. Cap 193 and rod 198 are tightened by adjustment slots 194 and 199 so that the grinder 150 is positioned tightly against the brake disc to be ground and so that members 121 and 122 move as a unit carrying grinders 150 and 158** with them, and cannot be forced apart or out of position by the warped portion.

An alternative arrangement for correcting a brake with "run out" can also be used, instead of bracing member 300. In the alternative method suitable means are used to lock pivot rod 182 tightly against pivoting in member 121. A suitable way of doing this is by extending the ends of pivot rod 182 through member 121 and threading the ends, and providing such ends with compression washers and nuts which can be screwed tightly against member 121 to prevent rotation. Preferably, pivot 186 is provided with threaded extensions and nuts to prevent pivoting about member 122. The locking of the pivot 182 (and preferably of the pivot 186 as well) provides rigidity of at least one of the grinders so that the grinding discs are not forced apart by the warped portion of a warped brake. This permits the grinding of a brake with run out, particularly as the screw connection between hole 204 and rod 205 fixes the pivot point 182 with respect to rod 205, which is not free to move toward or away from member 116.

In either of these two embodiments for preventing run out, extra rigidity is provided to the grinder 158 so that the shaft 156 of grinder 158 will not deflect when the warped portion of the brake disc passes in contact with the abrading face of that grinder. As described above, grinder 150 and grinder 158 move as a unit, so that the shaft 156 of grinder 150 is also made rigid. This ensures that the grinders do not "follow" the warped portion but rather grind it off. The grinders are free to pivot in their shafts 156, so that a small amount of "following" is permitted but the shafts 156 (i.e., the axes of the grinder units) are prevented from deflection.

Either configuration using the brace 300 or the configuration locking the pivot points permits the grinding down of warped portions which would previously, in many cases, have caused the disc to be scrapped.

It is understood that the foregoing has shown and described particular embodiments of the invention, and that variations thereof will be obvious to one skilled in the art. Accordingly, the embodiments are to be taken as illustrative rather than limitative, and the true scope of the invention is as set out in the appended claims.

I claim:

1. Apparatus for regrinding a vehicle brake disc mounted on a vehicle which apparatus comprises:

a rotatably abrading disc having an abrading face and being fixedly mounted for rotation about an axis at right angles to said face;

means for mounting such abrading disc from a portion of a vehicle which is fixed relative to the axis of the brake disc, such that said abrading face is positioned for rotation on a side of such brake disc in face-to-face frictional contact with such brake disc.

2. Apparatus for regrinding a vehicle brake disc which apparatus comprises:

a rotable abrading disc having an abrading face and being fixedly mounted for rotation at right angles to said face;

means for mounting such abrading disc from the caliper mounting of a vehicle such that said abrading face is positioned for rotation on a side of a brake disc mounted on such vehicle in face-to-face frictional contact with such brake disc.

3. Apparatus for regrinding a vehicle brake disc which apparatus comprises:

two rotatable discs each having an abrading face and each being fixedly mounted for rotation about an axis at right angles to its said face;

means for mounting said abrading discs from a portion of a vehicle which is fixed relative to the axis of rotation of the brake disc such that said abrading faces are positioned for rotation one on each side of the brake disc mounted on such vehicle and in face-to-face frictional contact with such brake disc.

4. Apparatus for regrinding vehicle brake discs which apparatus comprises:

two rotatable abrading discs each having an abrading face and each being fixedly mounted for rotation about an axis at right angles to its said face;

means for mounting such abrading discs on the caliper mounting of a vehicle such that said abrading faces are positioned for rotation one on each side of a brake disc mounted on such vehicle and in face-to-face frictional contact with such brake disc.

5. Apparatus for regrinding a brake disc in situ on a vehicle axle, which apparatus comprises:

a base member;

two relatively movable supporting members upstanding from the base member;

grinder support means supported by each of said supporting members;

axle means journalled in said grinder support means;

an abrading disc fixedly mounted on each axle means for rotation therewith, each abrading disc having a face perpendicular to its axle means, the face being provided with abrasive means;

said two abrading discs being orientable with their respective abrasive faces in face-to-face relationship to one another;

means for urging said abrading discs towards one another, and;

means for removable and adjustably attaching said base member to a portion of a motor vehicle which is fixed with respect to the axis of rotation of a brake disc on that motor vehicle, which brake disc is to be reground with the said abrasive faces on opposite sides of a vehicle brake disc and in contact with said vehicle brake disc.

6. Apparatus for regrinding a brake disc in situ on a vehicle axle, which apparatus comprises:

a base member;

two relatively movable supporting members upstanding from said base member;

a grinder support means mounted on each of said supporting members;

axle means journalled in each of said grinder support means;

an abrading disc fixedly mounted at the end of each axle means for rotation therewith, each abrading disc having a non-abrasive face, in which its axle means terminate perpendicular to said non-abrasive face, and an abrasive face on the other side of said disc; the face being coated with abrasive material;

said two abrading discs being orientable with their respective abrasive faces in face-to-face relationship to one another;

means for urging said discs towards one another; and, means for removably and adjustably attaching said base member to the caliper mounting of a vehicle brake disc unit with said abrasive faces on opposite sides of a vehicle brake disc and in contact with said vehicle brake disc.

7. Apparatus as claimed in claim 6, including bearing means mounted on each of said supporting members on the side of said grinder support means remote from said base member and bearing against the non-abrasive face of the abrading disc associated with said supporting member.

8. Apparatus as claimed in any of claims 1, 2, 3, 4, 5, 6, or 7 in which each abrading disc, when positioned as therein set forth, has its axis of rotation outside the periphery of the brake disc.

9. Apparatus as claimed in any of claims 5 or 6, in which said two abrading discs are oriented for rotation about the same axis of rotation.

10. Apparatus as claimed in claim 6, in which the grinder support means are mounted on shafts pivotally supported in said supporting members, each shaft being parallel to the abrading face of the abrading disc mounted on its respective grinder support means.

11. Apparatus as claimed in claim 10, in which the shafts are substantially parallel to one another but can be angularly adjusted slightly out-of-parallel, whereby to cause the two abrading discs to have their abrading faces slightly out of parallel in order to permit increased grinding pressure on a desired region of a brake disc.

12. Apparatus as claimed in either of claims 10 or 11, including means for preventing deflection of at least one said shaft during grinding.

13. Apparatus as claimed in either of claims 10 or 11, additionally including means coaxial with one of said shafts and fixing said shaft from deflection during grinding.

14. A method for regrinding a brake disc in situ on a vehicle, said brake disc being rotatable about an axle of said vehicle, which method comprises:

providing at least one abrading disc having an abrading face and rotatable about an axis of rotation perpendicular to its abrading face;

mounting said abrading disc from a portion of the vehicle which remains fixed with respect to the axis of rotation of the brake disc, with said abrading face of said abrading disc in face-to-face frictional contact with a face of the brake disc to be reground; and, rotating the brake disc while maintaining such frictional contact and such perpendicular relationship of such abrading disc to its axis of rotation.

15. A method for regrinding a brake disc in situ on a vehicle, said brake disc being rotatable about an axle of said vehicle, said vehicle also being provided with a brake caliper mounting bracket to mount brake calipers associated with said brake disc, which method comprises:

providing at least one abrading disc having an abrading face and rotatable about an axis of rotation perpendicular to its abrading face;

mounting said disc on said caliper mounting bracket such that the abrading face of such disc is in face-to-face frictional contact with the brake disc to be reground; and, rotating the brake disc while maintaining said frictional contact and such perpendicular relationship of such abrading disc to its axis of rotation.

16. A method for regrinding a brake disc in situ on a vehicle, said brake disc being rotatable about an axle of the vehicle, which method comprises:

providing two abrading discs each having an abrading face and each rotatable about an axis of rotation perpendicular to said abrading face;

mounting said discs from a portion of the vehicle which is fixed with respect to the axis of rotation of said brake disc, such that the abrading face of each disc is in face-to-face frictional contact with a face of the brake disc to be reground; and, rotating the brake disc while maintaining such frictional contact and such perpendicular relationship of such abrading discs to their axis rotation.

17. A method for regrinding a brake disc in situ on a vehicle as claimed in any of claims 14–16, in which the axis of rotation of each abrading disc lies outside the periphery of the brake disc.

18. A method as claimed in claim 16, in which the two said abrading discs have a common axis of rotation.

19. A method as claimed in any of claims 14, 15 or 16, in which each abrading disc present is caused to rotate only through contact with the rotating brake disc.

20. A method as claimed in any of claims 14, 15 or 16, in which each abrading disc present is powered for rotation independently from the rotation of the brake disc.

21. A method as claimed in claim 16, in which said abrading discs are oriented with their abrading faces at a slight angle from being parallel to one another, each of said abrading discs having its abrading face in frictional contact with an opposed face of the brake disc, whereby the non-parallel orientation of the abrading faces causes greater abrading pressure to occur in one region of the faces to be ground of the brake disc than in another, when the brake disc is rotated.

22. A method as claimed in claim 21, in which the axis of rotation of each abrading disc lies outside the periphery of the brake disc.

* * * * *